United States Patent [19]

Hickman

[11] Patent Number: 4,549,376

[45] Date of Patent: Oct. 29, 1985

[54] ROOF EDGE CONSTRUCTION

[75] Inventor: John B. Hickman, Asheville, N.C.

[73] Assignee: W. P. Hickman Company, Asheville, N.C.

[21] Appl. No.: 309,062

[22] Filed: Oct. 6, 1981

[51] Int. Cl.[4] ..... E04D 13/15

[52] U.S. Cl. ..... 52/94; 52/60

[58] Field of Search ..... 52/94, 96, 97, 58, 60, 52/717, 718, 466, 469, 254, 255

[56] References Cited

U.S. PATENT DOCUMENTS

| | | | |
|---|---|---|---|
| Re. 26,056 | 7/1966 | Hickman . | |
| 164,602 | 6/1875 | Shepard . | |
| 674,379 | 5/1901 | Hard | 52/731 |
| 1,299,425 | 4/1919 | Carpenter | 52/672 |
| 1,337,840 | 4/1920 | Hawley . | |
| 1,740,753 | 12/1929 | Vallas . | |
| 1,782,246 | 11/1930 | Schneider . | |
| 2,136,122 | 11/1938 | Almdale | 52/731 |
| 2,160,758 | 5/1939 | Schurman . | |
| 2,219,992 | 10/1940 | Hanson . | |
| 2,250,548 | 7/1941 | Ness . | |
| 2,554,779 | 5/1951 | Goodwin . | |
| 2,734,602 | 2/1956 | Dawson . | |
| 2,793,403 | 5/1957 | Livingston . | |
| 2,855,776 | 10/1958 | Trostle . | |
| 2,857,861 | 10/1958 | Trostle . | |
| 3,012,376 | 12/1961 | Reddy et al. | 52/96 |
| 3,024,573 | 3/1962 | McKinley . | |
| 3,090,161 | 5/1963 | Edwards . | |
| 3,237,352 | 3/1966 | Edwards . | |
| 3,389,515 | 6/1968 | Hellebrand | 52/96 |
| 3,405,485 | 10/1968 | Edwards . | |
| 3,444,658 | 5/1969 | Gobel | 52/60 |
| 3,447,273 | 6/1969 | Thom . | |
| 3,488,902 | 1/1970 | Gobel | 52/60 X |
| 3,503,162 | 5/1970 | Ward . | |
| 3,533,201 | 10/1970 | Tyler . | |
| 3,571,992 | 3/1971 | Comiskey . | |
| 3,608,225 | 9/1971 | Chomes . | |
| 3,624,973 | 12/1971 | Attaway . | |
| 3,668,811 | 6/1972 | Pollard . | |
| 3,696,575 | 10/1972 | Armstrong | 52/466 X |
| 3,712,003 | 1/1973 | Hallock et al. | 52/254 |
| 3,719,010 | 3/1973 | Hickman . | |
| 3,731,439 | 5/1973 | Hickman . | |
| 3,742,668 | 7/1973 | Oliver | 52/469 X |
| 3,802,140 | 4/1974 | Hickman . | |
| 3,812,634 | 5/1974 | Resech . | |
| 4,037,372 | 7/1977 | Patry | 52/96 |
| 4,071,987 | 2/1978 | Hickman . | |
| 4,241,549 | 12/1980 | Hall, III et al. | 52/97 X |

FOREIGN PATENT DOCUMENTS

| | | | |
|---|---|---|---|
| 603078 | 8/1960 | Canada . | |
| 1509147 | 11/1969 | Fed. Rep. of Germany | 52/58 |
| 1918761 | 10/1970 | Fed. Rep. of Germany . | |
| 1933004 | 1/1971 | Fed. Rep. of Germany . | |

(List continued on next page.)

OTHER PUBLICATIONS

Braas & Co. GmbH brochure entitled "PVC Flat-Roof Systems", (date unknown), 10 pages.

Braas Systems, Inc. brochure No. 1004NA, entitled "Purpose-Made Accessories for Braas Flat Roofs", dated 1/81 and 7/79?, 10 pages.

W. P. Hickman Co., "Hickman Aluminum Construction Products" 1980.

One-Sheet Copy of FIGS. 1, 2 and 3 from applicant's copending patent application, Ser. No. 256,893, filed Apr. 23, 1981.

Three-Sheet Copy of FIGS. 1 through 10*a* from applicant's copending patent application, Ser. No. 191,714, filed Sep. 29, 1980.

*Primary Examiner*—Alfred C. Perham

*Attorney, Agent, or Firm*—Harness, Dickey & Pierce

[57] ABSTRACT

A roof edge assembly includes a resilient member secured to the roof structure of a building. The resilient member has at least one sloping portion protruding upwardly and inwardly and serves to mount and support a fascia member on the edge of the roof structure. The assembly also functions to anchor the periphery of a sheet-like roofing material as well as acting as a gravel stop or barrier preventing water and other substances from falling off the edge of the roof.

5 Claims, 19 Drawing Figures

FOREIGN PATENT DOCUMENTS

| | | | |
|---|---|---|---|
| 1659340 | 1/1971 | Fed. Rep. of Germany | 52/96 |
| 2060292 | 6/1972 | Fed. Rep. of Germany . | |
| 2118981 | 10/1972 | Fed. Rep. of Germany . | |
| 2234975 | 2/1974 | Fed. Rep. of Germany | 52/94 |
| 2316266 | 10/1974 | Fed. Rep. of Germany | 52/57 |
| 2335223 | 1/1975 | Fed. Rep. of Germany | 52/94 |
| 1128360 | 8/1956 | France | 52/469 |
| 7610357 | 4/1977 | Netherlands | 52/96 |
| 7432 | of 1911 | United Kingdom | 52/731 |
| 1024071 | 1/1964 | United Kingdom . | |
| 1104027 | 2/1968 | United Kingdom . | |
| 1180965 | 2/1970 | United Kingdom . | |
| 1203344 | 8/1970 | United Kingdom . | |
| 1347974 | 2/1974 | United Kingdom . | |

ROOF EDGE CONSTRUCTION

BACKGROUND OF THE INVENTION

The invention relates generally to building structures and more particularly to roof edge constructions for buildings.

Reference may be had to U.S. Pat. Nos. 3,719,010, Re. 26, 056, and 4,071,987, as well as the references cited therein, for discussions and illustrations of gravel stop and fascia assemblies at the roof edges of buildings. The disclosures of the above-referenced patents are hereby incorporated by reference herein.

The above-referenced patents disclose various means for anchoring roofing materials to the buildings by use of decorative exposed fascia as well as various mounting means for securing the fascia to the building structure. Although such disclosures represent great strides over previous roof edge constructions in terms of simplicity and ease of installation, it has been found in many instances that it is desirable to increase the frictional engagement of the roofing material between the fascia and the mounting means, and further to anchor its terminal edge at a location close to the roof structure itself. Therefore, one of the objects of the present invention is to provide a spring-action or snap-on type fascia mounting and supporting system that allows the outer edge of the roofing material to be secured between the fascia and the mounting and supporting means at the outer edge of the roof structure. Another of the objects of the invention is to further increase both the simplicity of the components involved and the ease of installation. These and other objects of the invention will become readily apparent from the following discussion.

SUMMARY OF THE INVENTION

A resiliently yieldable member is attached to a roof structure and is adapted to resiliently mount and support a fascia member at the roof edge. The mounting and supporting member includes a vertical face portion adapted for attachment to the roof structure, preferably on a vertical surface thereof. Also included in such mounting and supporting member is at least one sloping portion extending generally in an upward and inward direction relative to the roof structure.

The roof structure typically includes a generally flat roofing material clamped or anchored to the mounting and supporting member. Preferably, the roofing material is frictionally captured between the fascia member and the mounting and supporting member. Most preferably, the roofing material is frictionally captured and clamped both between the fascia and a vertical face portion of the mounting member and between the fascia and an intermediate or upper portion of the mounting member. The clamping force exerted on the roofing material may be enhanced by means of bends or discontinuities in either the fascia or the mounting member, whereby the roofing material is frictionally interlockingly engaged and anchored to the roof edge assembly.

In the preferred embodiments, the sloping portion of the mounting and supporting member exerts a resilient biasing force on the roofing material in a generally outward direction relative to the roof structure. Such a generally outwardly-directed bias allows the roofing material to be anchored or clamped at the vertical face or edge of the roof structure without being pulled out of engagement with the vertical faces of the fascia or mounting and supporting member during installation of the fascia.

DETAILED DESCRIPTION OF THE PREFERRED EMBODIMENTS

Figure 1:
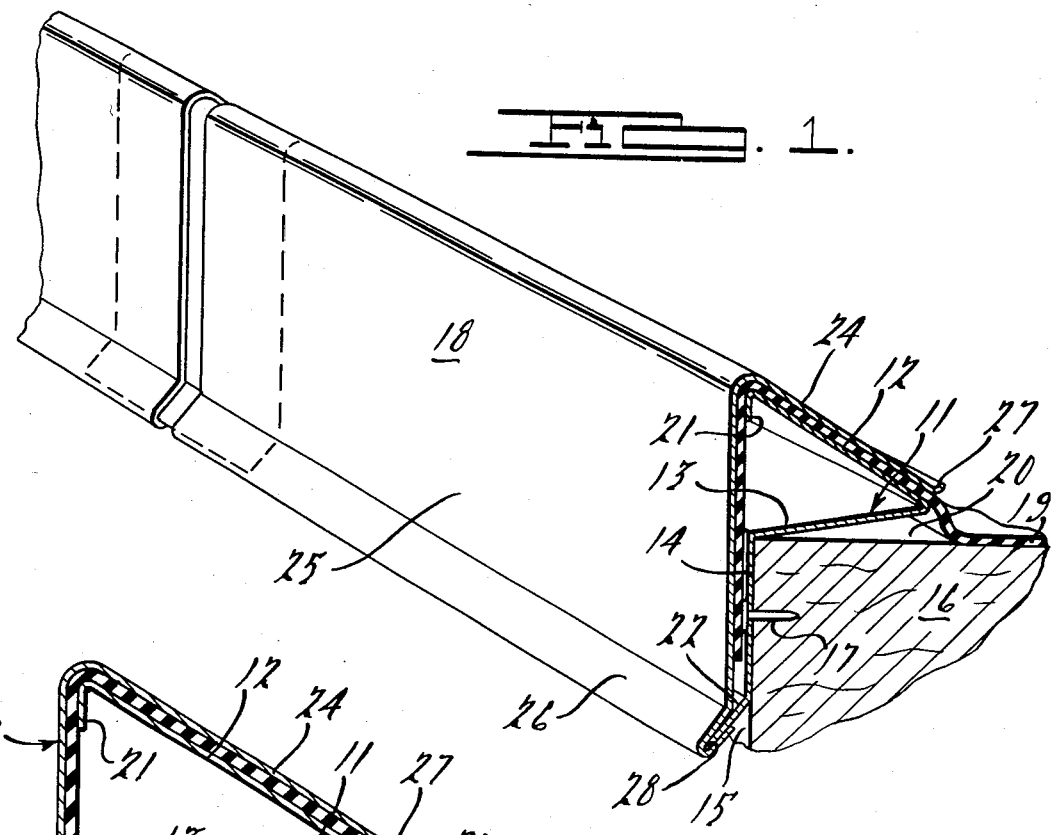
FIG. 1 is a perspective view of a resilient spring-action structure secured to the top edge of a building for mounting and supporting a fascia in accordance with the present invention.
Figure 2:
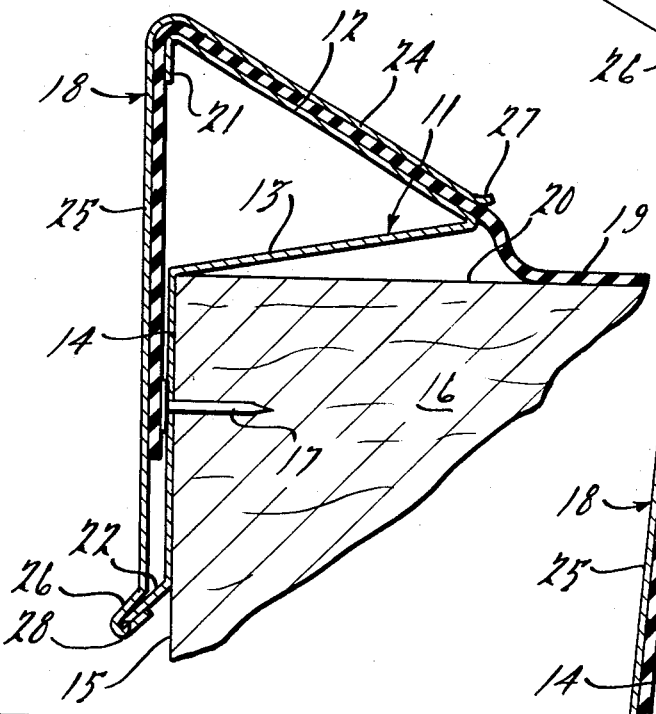
FIG. 2 is a right-hand end view of the fascia and mounting structure of FIG. 1.
Figure 3:
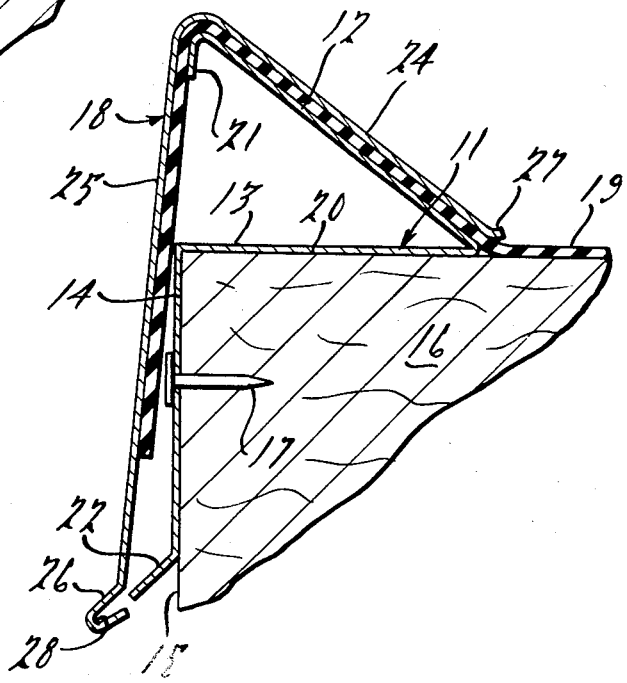
FIG. 3 is a right-hand end view of the fascia and the mounting and supporting structure of FIG. 1, illustrating the manner in which the fascia is assembled on the mounting and supporting structure.

Referring to the drawings, FIGS. 1 through 19 illustrate several embodiments of the invention, wherein elements that are common to more than one embodiment are indicated by common element numerals. In FIGS. 1 through 3, a mounting structure 11 includes an outwardly and upwardly sloping upper portion 12, an inwardly and upwardly sloping middle portion 13, and a generally vertical lower portion 14 secured to the vertical edge 15 of a building 16. Fascia member 18 is interlockingly attached to, and supported by, mounting structure 11 and thus frictionally captures the outer edge or terminal portion of roofing material 19 therebetween.

Lower portion 14 is shown secured to vertical edge 15 of building 16 by means of a fastener 17, for purposes of illustration only. One skilled in the art will readily appreciate that any number of known fastening means, including nails, screws or construction adhesives, may be employed to secure lower portion 14 to vertical edge 15 of building 16.

Upper portion 12 slopes upwardly and outwardly from middle portion 13, terminating in upper flange member 21. Upper flange member 21 extends vertically downward from upper portion 12 in FIGS. 1–3 and is generally coplanar with vertical lower portion 14. Middle portion 13 slopes upwardly and inwardly extending from lower portion 14 to upper portion 12. Lower portion 14 extends vertically downward along vertical edge 15 and terminates in lower flange member 22, which slopes downwardly and outwardly therefrom.

Fascia member 18 includes a downwardly and inwardly sloping cap portion 24, a vertical face portion 25 and a generally downwardly and outwardly sloping drip edge 26. Cap portion 24, which forms a generally concave shape with face portion 25, preferably includes an inwardly and upwardly protruding lip 27, and drip edge 26 includes a generally upwardly-presenting channel 28. If desired, face portion 25 may be constructed so as to extend upwardly beyond cap portion 24 or downwardly beyond upward-presenting channel 28.

Roofing material 19 is preferably a sheet-like material which may be resilient plastic, the more commonly-used tar paper or felt, or other suitable roofing sheet materials known in the art. Roofing material 19 flatly engages roof surface 20 and extends outwardly overlapping upper portion 12 and downwardly against upper flange 21 and lower portion 14 of mounting structure 11. Fascia member 18 is secured to mounting structure 11 to frictionally anchor or capture the roofing material 19 therebetween.

Mounting structure 11 is preferably fabricated from continuous sheet stock which is bent (or break) formed as is common in the art, such that its various portions are laterally and longitudinally continuous. If desirable, however, the upper, middle and lower portions as well as the upper and lower flange portions may be fabricated separately and then suitably interconnected without departing from the spirit and scope of the invention. Furthermore, mounting structure 11 may be longitudinally non-continuous, comprising a number of spaced longitudinal segments, if desired for a particular installation. The mounting structure 11 is preferably made of a sheet metal material, such as aluminum or steel, but can be made of any material which possesses an inherent resiliency such that at least middle portion 13 is resiliently yieldable when urged downwardly toward the roof surface 20, as shown in FIG. 3.

FIG. 3 illustrates the manner in which fascia member 18, as well as each fascia member in FIGS. 1 through 12, is installed on mounting structure 11. Once roofing material 19 is properly positioned over mounting structure 11, cap portion 24 of fascia member 18 is placed over upper portion 12 of mounting structure 11, with roofing material 19 therebetween. Fascia member 18 is urged downwardly so as to resiliently deflect, or collapse, middle portion 13 downwardly and inwardly, allowing drip edge 26 of fascia member 18 to clear lower flange 22 of mounting structure 11. Thereafter, fascia member 18 is released, and middle portion 13 of mounting structure 11 springs upwardly and outwardly such that drip edge 26 is captured on lower flange 22, as shown in FIGS. 1 and 2. In this manner, fascia member 18 is resiliently and removeably secured to mounting structure 11. Mounting structure 11 thus serves to mount or attach fascia member 18 to the building structure and also to support or reinforce fascia member 18 against various loads imposed on it such as those exerted by wind, water, snow and the like. Preferably, roofing material 19 is frictionally clamped in place between cap portion 24 and upper portion 12, as well as between face portion 25 and lower portion 14 of fascia member 18 and mounting structure 11, respectively. In some instances it has been found to be desirable to secure the roofing material close to the upper horizontal surface of the roof structure. The downwardly-sloping cap portion 24 shown in FIGS. 1 through 3 accomplishes this result as do the corresponding elements of the embodiments shown in FIGS. 4 through 7 and 10 through 17.

The sloping middle portion 13 of mounting structure 11 is resiliently deflected downwardly and inwardly when fascia member 18 is being installed thereon. Once released, middle portion 13 exerts a resilient biasing force on roofing material 19 in a generally outward direction relative to the remainder of the roof structure. The generally outwardly-directed force allows roofing material 19 to be frictionally anchored or clamped between the vertical lower portion 14 of mounting structure 11 and the vertical face portion 25 of fascia member 18 without being pulled out of engagement therewith when fascia member 18 is installed. Such a construction also greatly simplifies the fascia and mounting components and increases the ease of installation.

Figure 15:
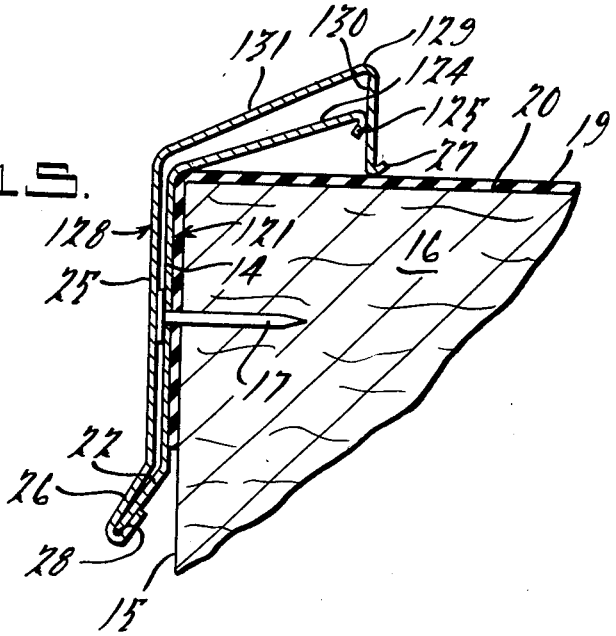
FIG. 15 is a view similar to that of FIG. 13, illustrating still another alternate embodiment of the invention in which the roofing material is positioned between the mounting structure and the roof edge.

The following description will reveal that all of the embodiments of the invention, except for that shown in FIG. 15, include a resilient portion of the mounting and supporting structure that slopes upwardly and inwardly relative to the roof structure, thus resiliently biasing roofing material 19 in a generally outward direction in a similar manner as described above.

Figure 4:
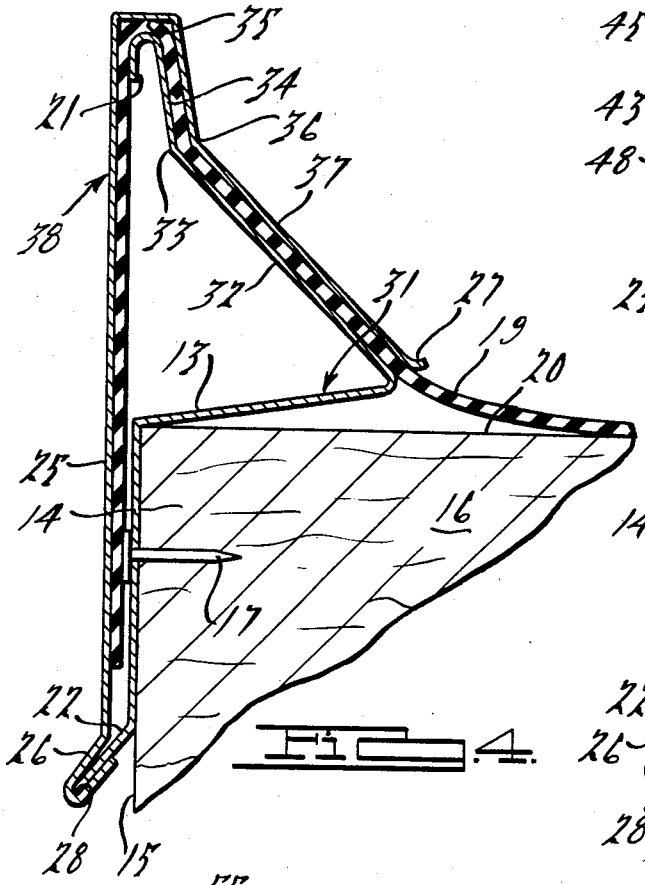
FIG. 4 is a view of a structure similar to that of FIG. 2, illustrating another embodiment of the invention, wherein the upper portion of the mounting and supporting structure includes a reverse bend therein.

FIG. 4 illustrates an alternate mounting structure 31, which is similar to mounting structure 11 of FIGS. 1 through 3 except that upper portion 32 includes a reverse bend 33, forming angled portion 34 thereon. Cap portion 37 of fascia 38 includes a reverse bend 36, corresponding to reverse bend 33 in mounting structure 31, and a downwardly-presenting channel 35 for receiving angled portion 34 and upper flange member 21. The presence of reverse bend 33 in upper portion 32 and reverse bend 36 in cap portion 37 results in an increased clamping force on roof material 19. Such increased clamping force enhances the frictional engagement of mounting structure 31 and fascia 38 with roofing material 19, thereby securing it more tightly in place.

Figure 5:
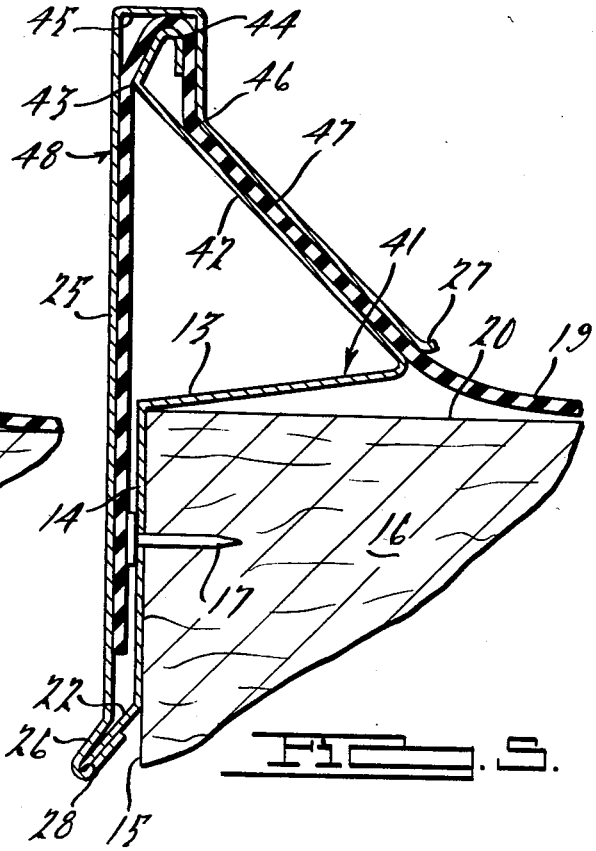
FIG. 5 is a view of a structure similar to that of FIG. 4, illustrating still another embodiment of the invention.

In FIG. 5, alternate mounting structure 41 is similar to mounting structure 31 of FIG. 4 with the exception of the presence of reverse bend 43 in upper portion 42. Reverse bend 43 forms hooked flange 44 at the top of upper portion 42 for frictionally engaging roofing material 19. Fascia 48 is similar to fascia 38 of FIG. 4 and includes downwardly-presenting channel 45 disposed between face portion 25 and cap portion 47. Fascia 48 also includes reverse bend 46 situated between downwardly-presenting channel 45 and cap portion 47. The configurations of fascia 48 and mounting structure 41 function to exert increased clamping forces on roofing material 19, thereby more tightly capturing it therebetween.

Figure 6:
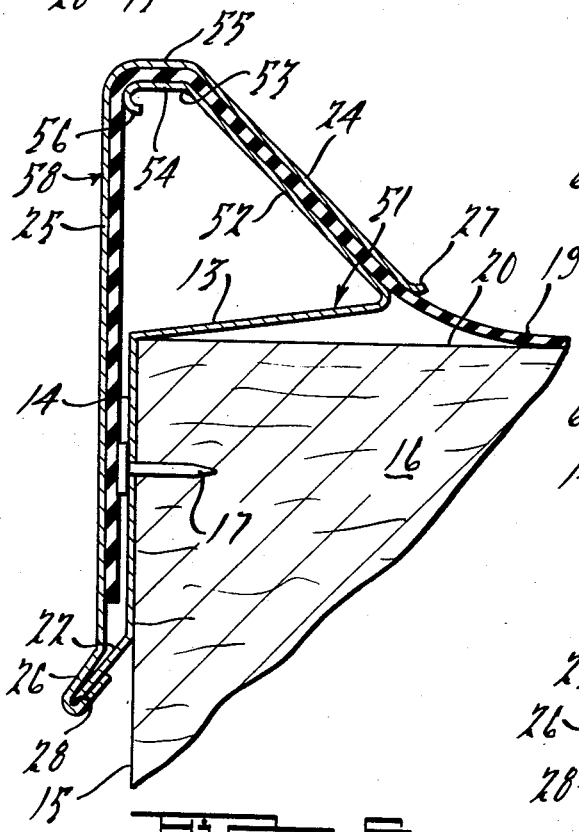
FIG. 6 is a view of a structure similar to that of FIG. 2, illustrating a further embodiment of the invention, wherein the upper portion of the mounting structure includes an outwardly-extending, generally horizontal protrusion.

FIG. 6 shows alternate fascia 58 installed on alternate mounting structure 51, which includes forward bend 53 in upper portion 52. Upper flange 54 extends forwardly and horizontally from forward bend 53 and terminates in bent-over lip 56. Fascia 58 includes horizontal portion 55, which is disposed between vertical face portion 25 and sloping cap portion 24 and extends over upper flange 54 with roofing material 19 therebetween. Mounting structure 51 and fascia 58, like those of the previously-discussed embodiments, are configured so as to increase the clamping force on, and the frictional engagement of, roofing material 19.

Figure 7:
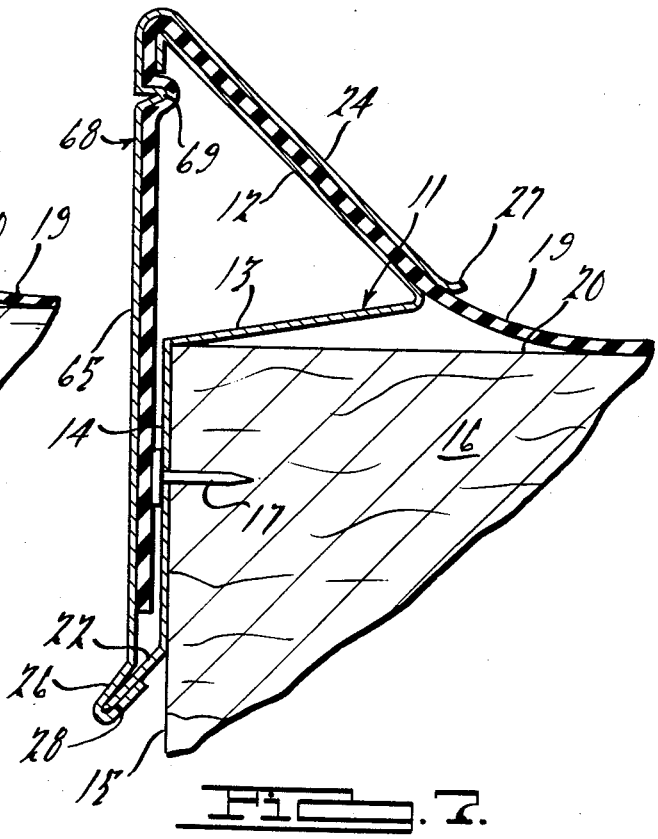
FIG. 7 is a view of a structure similar to that of FIG. 2, except that the fascia includes an inwardly-extending protrusion for engaging the roofing material.

FIG. 7 illustrates still another alternate embodiment of the invention which is similar to the embodiment shown in FIG. 1, except for the addition of an inwardly-protruding discontinuity or ridge 69 in face portion 65 of fascia 68. The ridge 69 increases the holding power of the fascia and mounting structure combination on the roofing material 19. Ridge 69 may be formed in face portion 64 by any known method such as rolling, pressing, bending, continuous staking, or by extruding (if fascia 68 is formed by an extrusion process). Ridge 69 is also equally applicable to many of the other embodiments of the invention and thus may be included therein if desired.

Figure 8:
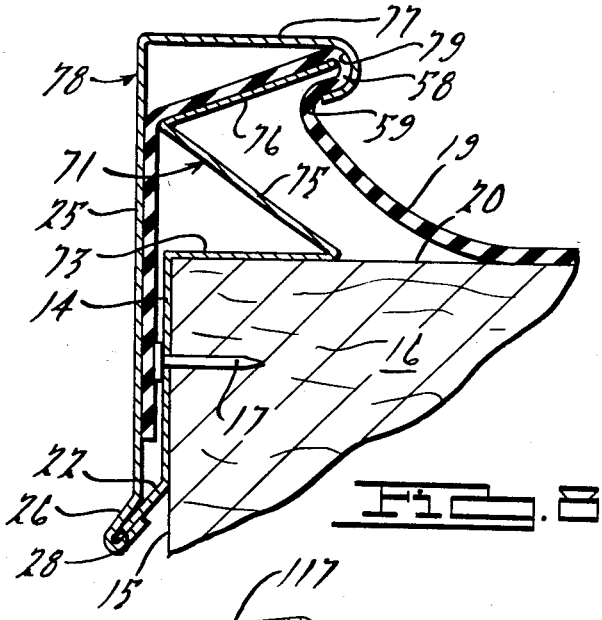
FIG. 8 is a view of a structure similar to that of FIG. 2, illustrating another alternate embodiment of the invention, wherein the upper portion of the mounting structure includes an inwardly-protruding horizontal portion for flatly engaging the roofing structure and an angular portion for engaging the fascia.

The alternate embodiment illustrated in FIG. 8 is similar in function and preformance to those previously discussed, but differs somewhat in its configuration. Mounting structure 71 includes vertical lower portion 14, horizontal middle portion 73, an upwardly and outwardly sloping lower leg 75 and an upwardly and inwardly sloping upper leg 76. Fascia 78 is similar to those of the embodiments discussed above except for the inclusion of horizontal cap portion 77 with outwardly-presenting channel 79 thereon. Like all the embodiments of the invention shown in FIGS. 1 through 12, fascia 78 is installed by hooking or capturing the free end of upper leg 76 in outwardly-presenting channel 79, urging fascia 78 downwardly to resiliently compress the sloping portions or legs of mounting structure 71 so that drip edge 26 clears lower flange member 22, and then releasing fascia 78 such that mounting structure 71 springs upwardly to capture lower flange member 22 in upwardly-presenting channel 28. Outwardly-presenting channel 79 and upper leg 76 interlockingly engage opposite sides of roofing material 19, thus, creating a set of reverse bends 58 and 59 therein. Such interlocking engagement securely clamps roofing material 19 to mounting structure 71 and thereby anchors it to the building structure.

Figure 9:
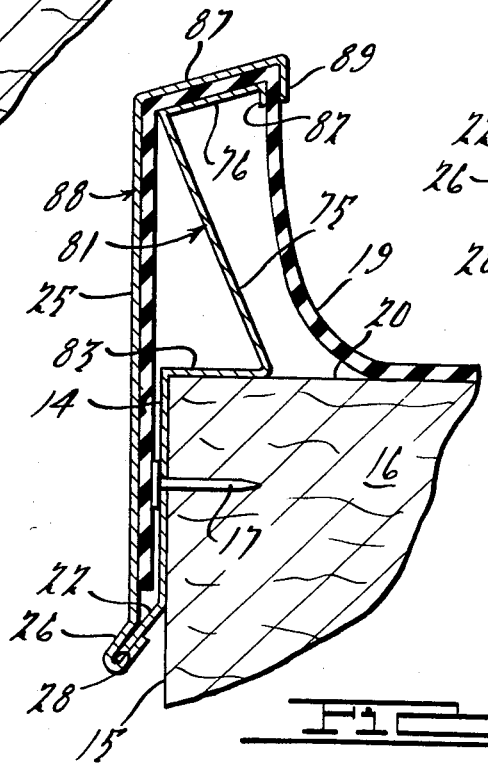
FIG. 9 is a view of a modified version of the structure illustrated in FIG. 8.

The embodiment shown in FIG. 9 is similar to that shown in FIG. 8, except that upper leg 76 of mounting structure 81 terminates in a downwardly-extending lip 82 and cap portion 87 of fascia 88 is sloped upwardly and rearwardly, including a downwardly-extending flange 89 to correspond with the sloping shape of upper leg 76 of mounting structure 81. Additionally, the extra height of fascia member 88 afforded by the configuration of FIG. 9 aids in keeping standing water or debris from falling off the edge of the roof.

Figure 10:
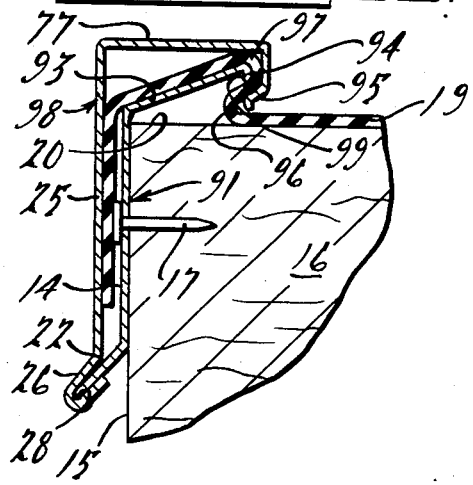
FIG. 10 is a view of an alternate embodiment of the invention wherein the upper portion of the mounting structure slopes upwardly and rearwardly and terminates in a downwardly-protruding lip engaging a channel-shaped portion of the fascia.

FIG. 10 illustrates still another alternate embodiment of the invention wherein upper portion 93 of mounting structure 91 protrudes upwardly and inwardly from vertical lower portion 14 and terminates in a downwardly extending lip 99. Outwardly-presenting channel 94 depends from cap portion 77 of fascia 98 and terminates in an inwardly hooked flange 95. The configuration shown in FIG. 10 imparts a set of reverse bends 96 and 97 in roofing material 19, thereby securely anchoring it between fascia 98 and mounting structure 91.

Figure 11:
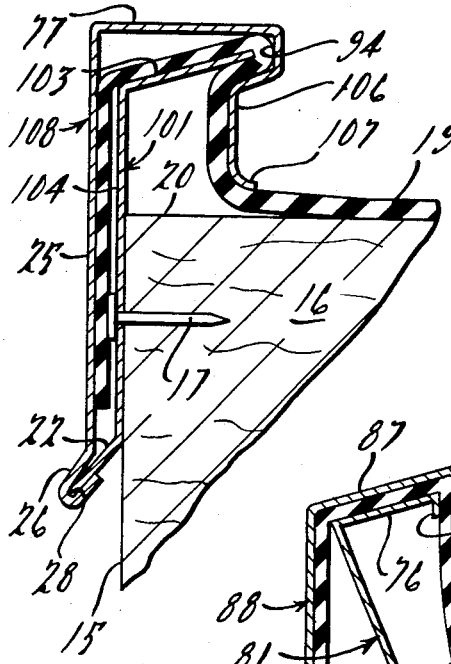
FIG. 11 is a view of a modified version of the embodiment of FIG. 10.

The FIG. 11 embodiment is similar to that of FIG. 10 with the addition of vertical leg 106 of fascia 108 which extends downwardly from outwardly-presenting channel 94 and terminates in radius 107 for engaging roofing material 19. Lower portion 104 of mounting structure 101 and face portion 25 of fascia 108 are vertically elongated to correspond with the increase in height resulting from the addition of vertical leg 106.

Figure 12:
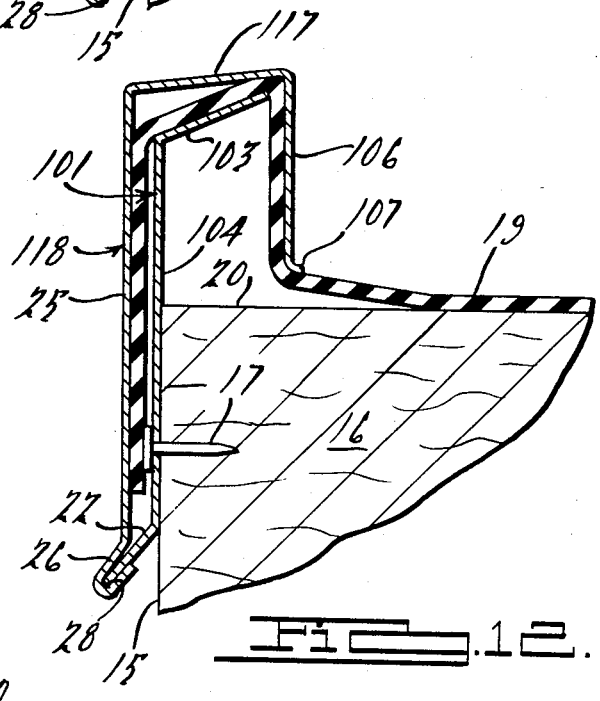
FIG. 12 is a view of a structure similar to that of FIG. 11, but including an alternate fascia configuration.

FIG. 12 illustrates an alternate fascia 118, similar to that of FIG. 11, but differing in that downwardly-extending vertical leg 106 depends directly from an upwardly and inwardly sloping cap portion 117 to engage roofing material 19.

The foregoing description relates to the embodiments of the present invention illustrated in FIGS. 1 through 12, all of which include a spring-action fascia installation as described in connection with FIG. 3. In such an installation, the fascia member's generally-concave upper portion is placed over the upper portion of the supporting and mounting structure. The fascia member is then swung and urged downwardly, thus downwardly deflecting the upper portion of the supporting and mounting structure, until the channel-shaped lower edge of the fascia member clears the lower edge of the supporting and mounting structure. Finally, the fascia member is released such that the supporting and mounting structure's lower edge protrudes into the channel-shaped lower edge of the fascia member. Upon release of the fascia member, the supporting and mounting structure's upper portion resiliently deflects upwardly capturing its lower edge in the channel-shaped lower fascia edge and interlockingly securing the fascia member to the supporting and mounting structure. In each of the embodiments in FIGS. 1 through 12, the inwardly and upwardly sloping segment of the upper portion of the mounting and supporting structure functions to resiliently bias the roofing material in a generally-outward direction.

Figure 13:
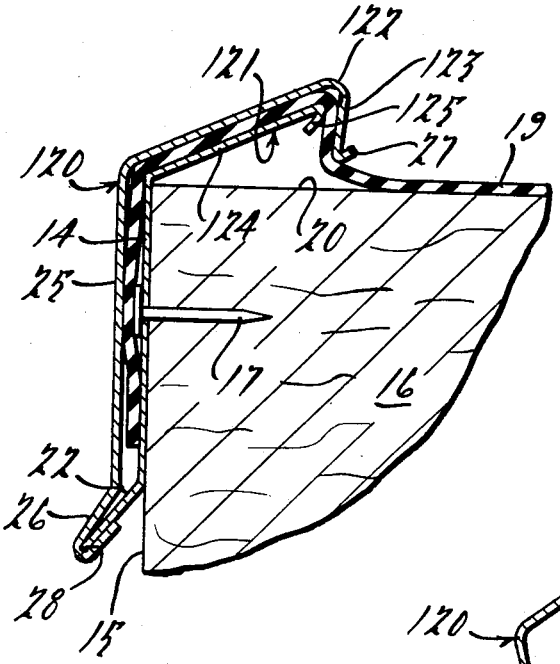
FIG. 13 is a right-hand end view of a fascia and mounting structure in which the fascia is snapped onto the resilient mounting structure.

In contrast to the above-described fascia member installation, FIGS. 13 through 19 illustrate several embodiments of another version of the present invention, featuring a snap-on type of fascia installation. In FIG. 13, fascia member 120 is shown secured to supporting and mounting structure 121, with roofing material 19 interposed therebetween. Supporting and mounting structure 121 is similar to those previously discussed, such as mounting structure 91 shown in FIG. 10. Upper portion 124 resiliently protrudes in an upward and inward direction, relative to building 16 and terminates in flanged upper edge 125. Generally-concave cap portion 122 of fascia member 121 also extends in an upward and inward direction corresponding to upper portion 124 of mounting structure 121. Cap portion 122 also includes downwardly-extending flange 123 having lip 27 thereon.

Figure 14:
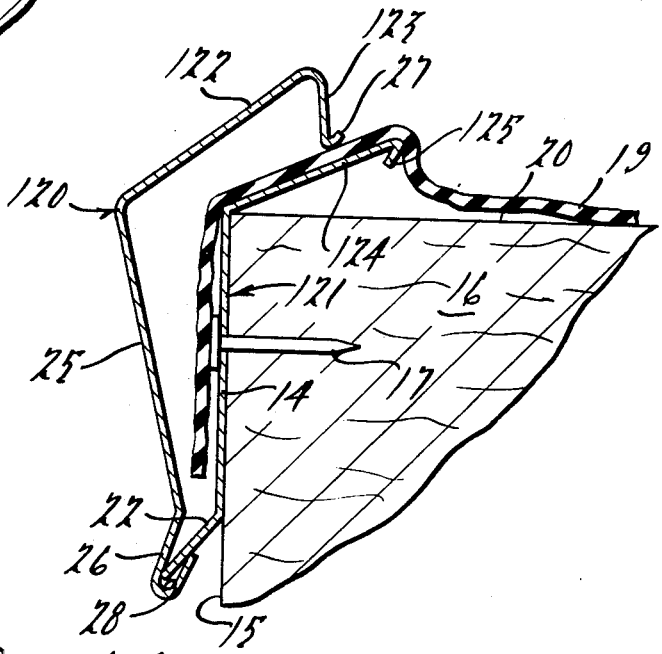
FIG. 14 is a right-hand end view of the structure of FIG. 13, illustrating the manner in which the fascia is snapped into place.

As is illustrated in FIG. 14, fascia member 120 is installed by first hooking or capturing lower flange member 22 of mounting structure 121 in upwardly-presenting channel 28 of fascia drip edge 26. Fascia member 120 is then swung or pivoted upwardly and inwardly until lip 27 bears against upper portion 124 of mounting structure 121 through roofing material 19. As fascia member 120 is urged inwardly, it compresses or deflects resilient upper portion 124, allowing fascia flange 123 and lip 27 to slidably move inwardly beyond flanged upper edge 125. Once flanged upper edge 125 is clear of fascia flange 123 and lip 27, upper portion 124 resiliently retracts, and fascia member 120 is snapped into place as shown in FIG. 13. Other alternate embodiments of the invention in which the fascia member is snapped onto the supporting and mounting structure are shown in FIGS. 15 through 19. Such fascia and mounting structure simplifies the roof edge components and increases the ease of installation.

In FIG. 15, mounting structure 121 and fascia member 128 are similar to those shown in FIG. 13, except roofing material 19 is installed between mounting structure 121 and the roof of building 16. Also differing from the embodiment of FIG. 13, cap portion 129 includes an elongated flange portion 130 which extends downwardly to engage roofing material 19. Top portion 131 of cap portion 129 is sloped, but vertically spaced from the upper surface of resilient upper portion 124 of mounting structure 121 such that when fascia member 128 is snapped into place, upper portion 124 exerts a downward biasing force against flange portion 130, to clamp roofing material 19 securely against roof surface 20. The FIG. 15 embodiment also differs from those previously discussed in that since roofing material 19 is disposed between mounting structure 121 and building 16, it may therefore be secured to vertical edge 15 of building 16 by means of vertical portion 14 of mounting structure 121 and fastener 17 extending therethrough.

Figure 16:
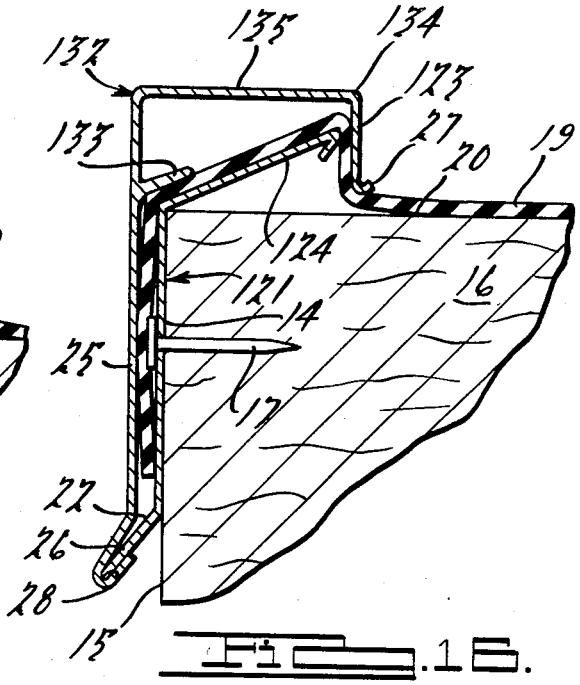
FIG. 16 is a view of a structure similar to that of FIG. 13, wherein the fascia includes a fine or discontinuity for frictionally engaging the roofing material.

The alternate embodiment shown in FIG. 16 is similar to that of FIG. 13, with the addition of an inwardly projecting fin or discontinuity 133 on fascia member 132, which further frictionally clamps roofing material 19 to mounting structure 121.

Figure 17:
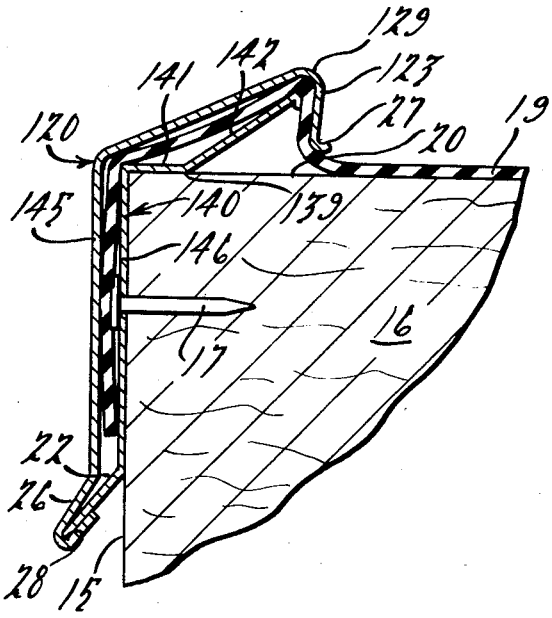
FIG. 17 is a view of a modified version of the embodiment depicted in FIG. 13.

FIG. 17 illustrates an alternate embodiment similar to that of FIG. 13 except for the inclusion of bend 139 in mounting structure 140, between horizontal portion 141 and sloping upper portion 142. Such a configuration increases the stiffness of sloping upper portion 142 as well as making mounting structure 140 easier to position on vertical edge 15 because of the positive engagement of horizontal portion 141 with roof surface 20.

Figure 19:
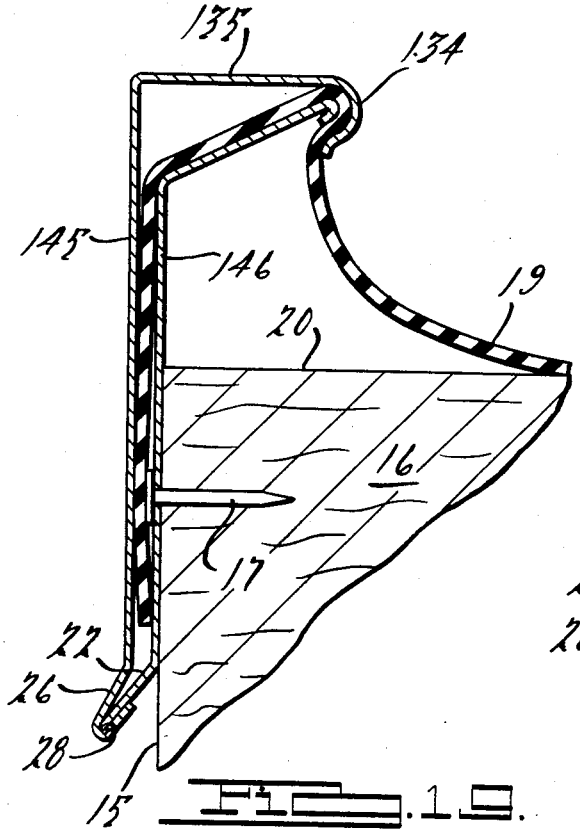
FIG. 19 illustrates a modified version of the embodiment of FIG. 18.
Figure 18:
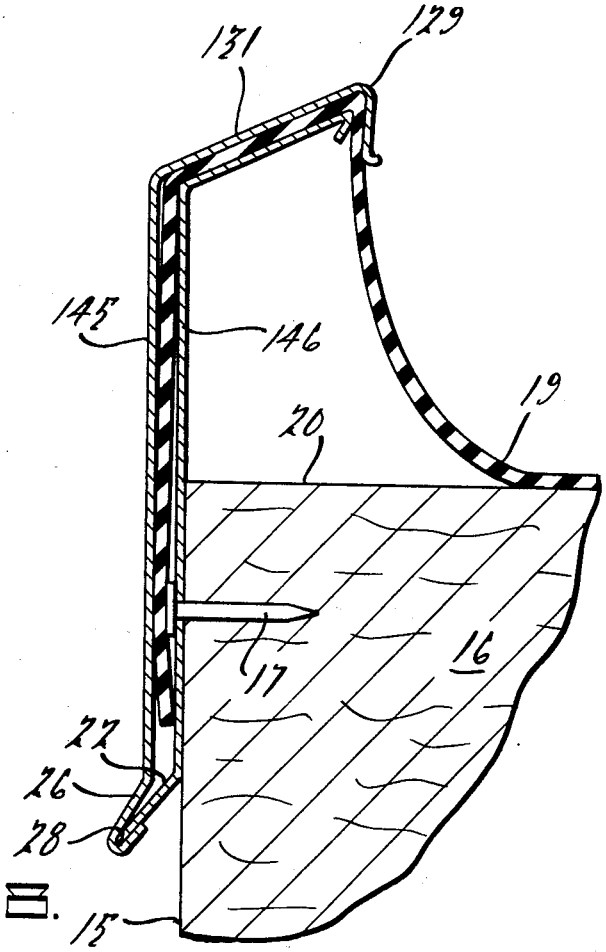
FIG. 18 is a view of an alternate embodiment, similar to that of FIG. 13, wherein the vertical faces of the fascia and mounting structure are elongated to increase the overall height of the roof edge structure.

FIGS. 18 and 19 show configurations employed in previously-discussed embodiments and illustrate the vertical elongation of fascia face portion 145 and mounting structure lower portion 146. Such vertically elongated elements may be employed where a higher raised edge is desirable to keep large amounts of standing water or roof debris from falling over the edge of the building.

The foregoing descriptions represent merely exemplary embodiments of the present invention. Various changes may be made in the arrangements and details of production of the embodiments shown without departing from the spirit and scope of the present invention.

I claim:

1. An assembly for formng a raised roof edge on a building structure having a generally vertical outer face, comprising:

a spring clip member having a generally vertical portion for attaching to said outer face, said vertical portion having a lower edge and having an inwardly directed face for confronting said outer face;

said spring clip having a first sloping portion extending generally upwardly and inwardly and having a second sloping portion extending further upwardly and outwardly;

a fascia member supported on said spring clip member, said fascia member having a lower channel portion and a generally concave upper portion;

said second sloping portion being received within said concave upper portion and said lower edge being received within said lower channel portion;

wherein at least said first sloping portion is resiliently deflectable in response to manually applied forces to permit assembly and disassembly of said lower edge within said lower channel portion.

2. The assembly according to claim 1, further comprising roofing material overlappingly engaging said spring clip member and anchored between said fascia member and said spring clip member.

3. The assembly according to claim 2 wherein said roofing material overlappingly engages said second sloping portion of said spring clip member and wherein said first sloping portion of said spring clip member exerts a resilient biasing force for frictionally capturing said roofing material between said second sloping portion and said fascia member.

4. The assembly according to claim 3 wherein said roofing material also overlappingly engages said generally vertical portion of said spring clip member.

5. The assembly according to claim 2 wherein said fascia member includes a protruberance which is interlockingly engagable with said roofing material.

* * * * *

UNITED STATES PATENT AND TRADEMARK OFFICE

CERTIFICATE OF CORRECTION

PATENT NO. : 4,549,376

DATED : Oct. 29, 1985

INVENTOR(S) : John B. Hickman

It is certified that error appears in the above-identified patent and that said Letters Patent is hereby corrected as shown below:

Col. 2, Line 34; "roofing" should be --roof--

Col. 2, Line 59; "fine" should be --fin--

Col. 3, Line 68; "resilency" should be --resiliency--

Col. 5, Line 36; "64" should be --65--

Col. 5, Line 43; "preformance" should be --performance--

Title page (pg. 2) under Foreign Patent Documents, Document No. 7432; "of 1911" should be -- 3/1911 --.

Signed and Sealed this

*Fifth* Day of *August 1986*

[SEAL]

*Attest:*

DONALD J. QUIGG

*Attesting Officer*

*Commissioner of Patents and Trademarks*